United States Patent [19]

Bernhardt

[11] 4,346,833

[45] Aug. 31, 1982

[54] REPLACEABLE MULTIPLE SEAL PACKAGE

[76] Inventor: Daniel Bernhardt, P.O. Box 681, Rutland, Vt. 05701

[21] Appl. No.: 248,996

[22] Filed: Mar. 30, 1981

Related U.S. Application Data

[63] Continuation-in-part of Ser. No. 175,367, Aug. 5, 1980, and Ser. No. 187,464, Sep. 15, 1980.

[51] Int. Cl.[3] ..... B65D 5/64; B65D 43/00

[52] U.S. Cl. ..... 229/43; 220/359; 206/459; 215/350

[58] Field of Search ..... 229/43; 220/257, 359; 206/606, 629, 459; 215/251, 253, 349, 350, 6, 273

[56] References Cited

U.S. PATENT DOCUMENTS

| | | | |
|---|---|---|---|
| 2,880,859 | 4/1959 | Tupper | 215/251 |
| 3,344,974 | 10/1967 | Bostrom | 229/43 |
| 3,552,634 | 1/1971 | Ollier | 220/257 |
| 3,561,668 | 2/1971 | Bergstrom | 220/359 |
| 3,765,595 | 10/1973 | Reinhardt | 229/43 |
| 3,997,677 | 12/1976 | Hirsch | 229/43 |
| 4,000,816 | 1/1977 | Spruyt | 220/359 |
| 4,040,561 | 8/1977 | Philippon | 220/257 |

*Primary Examiner*—Herbert F. Ross

*Attorney, Agent, or Firm*—Mark T. Basseches; Paula T. Basseches

[57] ABSTRACT

The present invention relates to a recloseable multi-seal package for food or the like characterized in that a triple seal of the contents is effected, and further characterized in that, upon removal of a sealing film or membrane, identifying indicia printed on a central portion of the film remain on a replaceable cover member.

14 Claims, 3 Drawing Figures

REPLACEABLE MULTIPLE SEAL PACKAGE

This application is a continuation-in-part of my copending applications Ser. No. 175,367, filed Aug. 5, 1980 and Ser. No. 187,464, filed Sept. 15, 1980.

BACKGROUND OF THE INVENTION

1. Field of the Invention

The present invention is in the field of containers and is directed more particularly to a recloseable container especially adapted for the packaging of comestibles or like food articles but is not restricted to such use. More particularly, the invention pertains to a container which provides a hermetic seal as originally distributed, and which is recloseable after opening.

2. The Prior Art

Containers, and particularly containers of transparent or opaque polymeric material, are in common use for a wide variety of articles and particularly for comestibles, such as candy, food portions or the like. Such containers may typically be comprised of shaped polymeric materials which have been injection molded or vacuum formed.

It is known to provide such containers with a surrounding flange and seal such containers by contacting the flange with an overlying membrane or film which is secured to the flange as by effecting a perimetrical heat seal therewith or by interposing a pressure sensitive or other adhesive between the flange and the film.

While such containers are in widespread use, especially in the merchandizing of articles which are to be consumed in one sitting, the containers are not subject to reclosing and, thus, are of limited utility in respect of packages which are to be opened, partially emptied, and thereafter stored.

Containers of the film sealed type hereinabove described have the further drawback that if the seal is not complete, i.e. is compromised, at some point or area, the contents are prematurely exposed to enviornmental influences.

As an example of a container of the type described, reference may be made to my U.S. Pat. No. 3,765,595 of Oct. 16, 1973, and certain of the art cited therein.

In my copending applications Ser. Nos. 175,367 and 187,464 there are described improved container devices wherein a container having a flange is provided with a reuseable cap member forming a frictional connection with the interior walls of the container, the cap member having a surrounding flange in coplanar alignment with the flange of the container. An overlying membrane or film is secured in covering relation of the container. First and second continuous perimetrical sealing connections are effected between the membrane and the flanges of the container and cover, respectively, whereby there is provided a triple seal for the contents so long as the membrane remains in position. After removal of the membrane, the container may be reclosed by replacement of the cap or cover.

It is frequently desired to provide markings or indicia, such as brand identification, use directions or the like for such packages. Such indicia may be applied directly to the cap and, where the sealing film or membrane is transparent, are visually accessible through the membrane at the time of sale. The indicia in such devices will remain on the cap and thus be accessible after the membrane is removed. However, it will be readily recognized that the process of applying indicia to three dimensional plastic articles, such as the cap components of my above referenced copending applications, is a relatively expensive procedure.

Clearly, it is more convenient to imprint identifying and direction markings or the like on the film per se. However, where the markings are effected on the film or membrane, removal of the membrane results in removal of the markings.

SUMMARY

The present invention may be summarized as directed to an improved recloseable container having the advantages of my aforesaid copending applications and further characterized in that indicia may be applied to the sealing membrane. The membrane, in the course of application, and particularly the indicia-bearing portions thereof, become permanently bonded to increments of the cap portion whereby, when the membrane is removed, certain portions thereof which include the indicia remain as permanent parts of the cap.

The described device provides the manufacturing advantage of enabling a stock container and cap to be used, the container being differentiated or customized by imprinting indicia on the membrane which becomes permanently integrated with the cap or cover in the course of sealing the container.

More particularly, the present invention is directed to a package, preferably fabricated of polymeric material, having a surrounding flange, a cover member having a depending skirt portion which frictionally engages inner wall portions of the container and having a flange in coplanar alignment with the flange of the cover, the cover including a central raised portion or table which is also in coplanar alignment with the previously mentioned flanges. The sealing film or membrane is imprinted with indicia at a portion which will lie in registry with the table.

The membrane is secured to the package by forming first and second perimetrical seals between the film and the flanges of the cover and container, respectively, a third seal area being defined between the indicia bearing components of the film and the table.

Optionally a weakened score or tear line is formed in the membrane before or during application of the membrane to the container. Removal of the membrane results in rupture of the film at the score or tear line or at the borders of the table where no seal line is used, whereby the portions surrounded by the tear line or border remain as permanent parts of the cover.

Accordingly, it is an object of the invention to provide an improved recloseable container.

A further object of the invention is the provision of a container of the type described wherein indicia may be marked on the covering membrane and after separation of the membrane to open the container, the indicia bearing components will remain as a permanent part of the cap of the recloseable container.

To attain these objects and such further objects as may appear herein or be hereinafter pointed out, reference is made to the accompanying drawings, forming a part hereof, in which.

Figure 1:
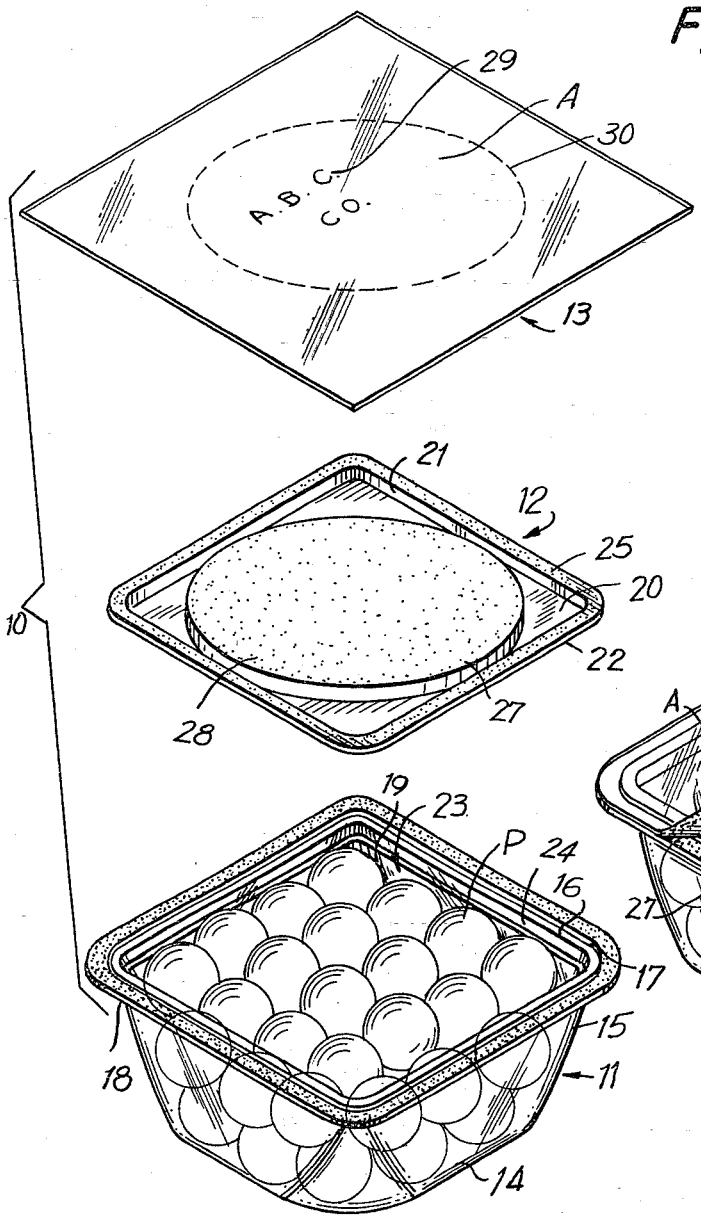
FIG. 1 is an exploded perspective view of the components of a package in accordance with the invention.

Turning now to the drawings, there is disclosed a package assembly 10 which is comprised of a container portion 11, a cover or lid 12 and a sealing membrane 13.

The container component 11, which is essentially identical to that shown in my copending application Ser. No. 175,367 may be comprised of a transparent polymeric material such as acetate, polyester, polystyrene composition or the like. Alternatively, polymeric foam or an opaque plastic may be employed.

Referring more particularly to the figures, the container 11 may include a bottom wall 14, side walls 15, a ledge member 16, a rim member 17 extending upwardly from the ledge member, and an upwardly directed perimetrical flange 18. Optionally, a stop shoulder 19 may be formed at an intermediate position along the wall portions 15.

The cap member 12 includes a body portion 20 surrounded by a depending skirt 21, the uppermost margins of the skirt including a laterally directed perimetal flange or shoulder 22.

When the cap member is positioned within the open mouth 23 of the container 11, it will be perceived that the flange or shoulder 22 lies in the recess defined between the ledge 16 and the rim 17 of the container, and that the skirt 21 forms a tight frictional fit with the wall portions 24 between the ledge and the stop shoulder.

It will be further seen that the depth of the rim 17 is calculated such that the upper surface 25 of the flange or shoulder 22 of the cap and the upper surface 26 of the flange 18 of the container are in coplanar alignment.

The cap of the invention is provided with a raised central table portion 27 having an upper surface portion 28 which is in coplanar alignment with the upper surface portions 25, 26 of the cover or cap 12 and container 11, respectively.

While in the illustrated embodiment the table is shown to be circular in plan, it will be readily recognized that any desired shape of table may be employed.

The covering film or member 13, as shown in FIG. 1, is shaped in plan such as substantially to register with the outermost boundary 18 of the container 11. Indicia or markings 29 may be imprinted on the membrane or film 13 at a central area A which, in the assembled condition, will register with the raised table 27 of the cover 12. Preferably, the film 13 includes a weakened score line or perforation line 30 surrounding the indicia components 29.

The device is assembled by first filling the container with the product P to be dispensed and thereafter positioning the cover 12 within the open mouth portion 23 of the container, pressing the same downwardly to achieve frictional interfit between the skirt 21 and portions 24 of the walls 15 of the container. Thereafter the film 13 is placed in registry with the uppermost surface of the container and is sealed or bonded to the uppermost surfaces of the cap and container.

The seal is preferably effected by a heat sealing step but, alternatively, may be secured by adhesive, such as by a pressure sensitive adhesive connection. Optionally, the entire undersurface of the film 13 may be coated with a pressure sensitive adhesive.

In the course of seal formation, a first perimetrical seal area 31 is defined between the undersurface of the film 13 and a registering area of the flange 18 of the container.

Preferably a second seal area 32 is formed between the membrane 13 and the upper surface 25 of the flange or shoulder 22 of the cap member.

A further seal 33 is effected between upper surface 28 of the table 27 and a portion or the portions of the film which register with the table.

It will thus be seen that there results a package sealed by the frictional interfit of the cap or cover and the container and also by the seal lines 31 and 32.

While the perforation or score line 30 may be disposed anywhere in the area of the film, it is preferred that such line 30 be in slightly overlapping relation of the table 27 whereby the seal effected between the membrane and the table surrounds the score line and precludes the ingress of moisture, etc. through the score or weakened tear line 30 and into the area protected by the seal 32. It should be noted, however, that even if the score line 30 is formed outwardly of the periphery of the table, the contents of the container are sealed by the seal 32 and by the frictional interfit between the cover and the inner walls of the container. The tear or score line may be eliminated since, even in the absence thereof, there is a substantial tendency for the membrane to tear at an area in registry with the margins of the table.

Figure 2:
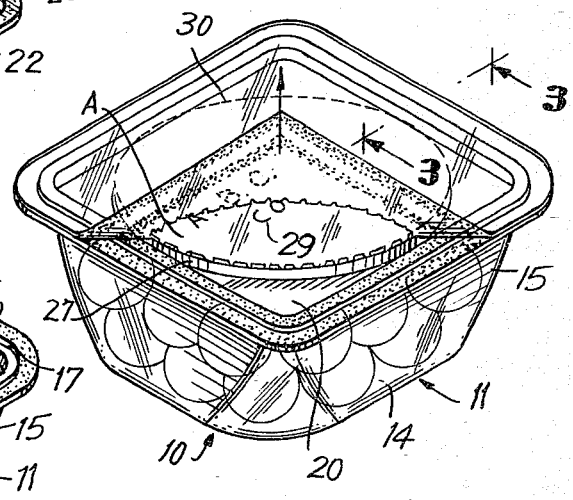
FIG. 2 is a perspective view of a completed package in accordance with the invention in the course of opening the same.
Figure 3:
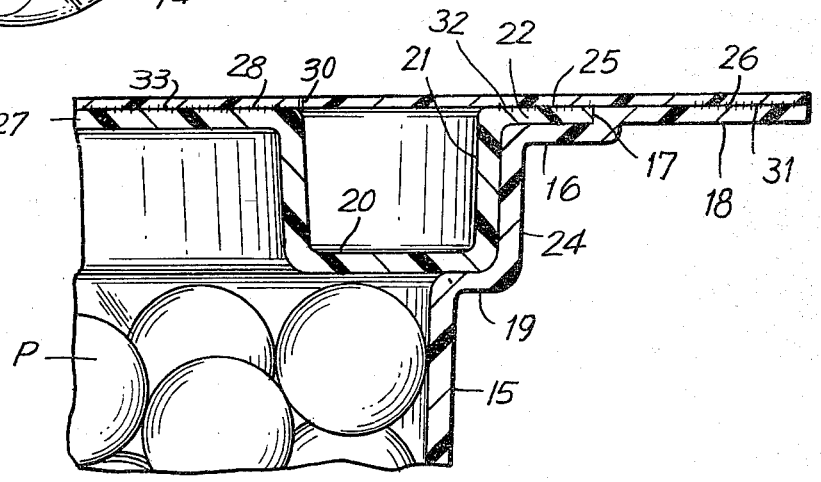
FIG. 3 is a magnified vertical section taken on the line 3—3 of FIG. 2.

When it is desired to open the device, the user merely tears the membrane upward (see FIG. 2) and separates the membrane from connection with the flange or shoulder 22 of the cover and the flange 18 of the container. The tearing action may be facilitated by providing an extending tab (not shown) on the membrane or by punching a hole through the membrane in the area between the skirt 21 and the table.

In the course of tearing away the membrane, the components thereof disposed within the score line 30 will remain attached to the table 27 and, thus, the indicia 29 carried by the membrane or film will remain permanently affixed to the cover and be accessible so long as the cover is retained.

As will be appreciated from the preceding description, there is provided in accordance with the present invention a recloseable package assembly which is susceptible of being manufactured from a stock container and cap, yet readily customized as a result of the application of an indicia marked sealing film thereto, the indicia bearing portions of which sealing film are retained as a permanent part of the cover assembly. Opening of the container and removal of the film results in portions of the film bearing the indicia remaining on the cap and being separated from the portions of the film surrounding the table.

Numerous variations in structural details may be made in the described package device without departing from the spirit of the invention. Accordingly, the invention is to be broadly construed within the scope of the appended claims.

Having thus described the invention and illustrated its use, what is claimed as new and is desired to be secured by Letters Patent is:

1. A recloseable multiple seal package for food or the like comprising a container having a bottom and side wall portions extending upwardly from said bottom, the upper ends of said wall portions defining an open mouth portion, a laterally directed ledge member extending outwardly from the upper extremity of said side wall portions, a rim member extending upwardly from the outer extremity of said ledge member, and an outwardly directed perimetrical flange extending from the upper extremity of said rim, said flange and ledge being vertically offset, a cap member disposed in closing position of said mouth portion, said cap member including a depending skirt disposed within said container and frictionally engaging the inner faces of said side wall portions, a laterally outwardly directed shoulder extending from said skirt, said shoulder overlying said ledge member and having an upper surface in substantial coplanar alignment with the upper surface of said flange, a raised table portion formed on said cap member within the area defined by said skirt, said table portion including an upper planar face portion in substantial coplanar alignment with said upper surface of said flange, a resilient closure film in registry with said flange, first and second substantially continuous perimetrical seal connections defined between said film and the said upper surface of said flange and said shoulder, respectively, and a central connection area defined between said film and said upper face of said table, said central connection area including means for securement of said film to said cap member, indicia means on the central area of said film in registry with said table, said securement means retaining the central area of said film on said table upon removal of the film from the cap.

2. A container in accordance with claim 1 wherein said table portion includes upwardly directed side wall portions spaced inwardly from said skirt of said cap member.

3. A container in accordance with claim 2 wherein said film includes a weakened tear line encircling a portion of said film spaced inwardly from said skirt.

4. A container in accordance with claim 3 wherein said tear line is in substantial coincidence with the border of said side wall portions of said cap member.

5. A container in accordance with claim 3 wherein said tear line is in the area between said skirt of said cap and said table.

6. A container in accordance with claim 3 wherein said tear line is in registry with said table and the central connection area is a substantially continuous seal area between said film and said table within the confines of said tear line.

7. A container in accordance with claim 1 wherein said film is formed with a weakened tear line surrounding said indicia means.

8. A container in accordance with claim 7 wherein said tear line is in substantial coincidence with the border of said side wall portions of said cap member.

9. A container in accordance with claim 7 wherein said tear line is in registry with said table and a further substantially continuous seal area is formed between said film and said table surrounding said tear line.

10. A container in accordance with claim 1 wherein said film is transparent.

11. A container in accordance with claim 10 wherein said film includes a weakened tear line surrounding said indicia means.

12. A recloseable multiple seal package comprising a container having a bottom and side wall portions extending upwardly from said bottom, the upper ends of said wall portions defining an open mouth portion, a laterally directed flange extending outwardly of said wall portions, said flange including a planar upper surface, a cap member disposed in closing position of said mouth portion, said cap member including a depending skirt disposed within said container and frictionally engaging inner faces of said side wall portions, said cap member including perimetrical portions disposed in coplanar alignment with said upper surface of said flange, a raised table portion formed on said cap member within the area defined by said skirt, said table portion including an upper planar face portion in substantial coplanar alignment with said upper surface of said flange, a resilient closure film sealingly connected to said flange along a first substantially continuous perimetrical seal line, said film having indicia means in registry with said table and being sealingly connected to said table at least in the area in registry with said indicia means.

13. A package in accordance with claim 12 and including a weakened tear line in said film surrounding said indicia means.

14. A package in accordance with claim 12 and including a second continuous perimetrical seal area between said film and said perimetal portion of said cap.

* * * * *